United States Patent [19]

Derbyshire

[11] 3,974,868

[45] Aug. 17, 1976

[54] HAND TOOLS

[75] Inventor: George Cecil Derbyshire, Sheffield, England

[73] Assignee: The Jacobs Manufacturing Company Limited, Sheffield, England

[22] Filed: Aug. 28, 1975

[21] Appl. No.: 608,541

Related U.S. Application Data

[62] Division of Ser. No. 526,042, Nov. 21, 1974, Pat. No. 3,935,889.

[52] U.S. Cl. ..... 145/24; 30/168; 30/335; 30/339; 30/340; 30/342; 145/50 B

[51] Int. Cl.[2] ..... B25D 3/00

[58] Field of Search ..... 145/24, 25, 26, 50 B; 30/340, 342, 344, 168, 335, 339, 162, 163

[56] References Cited

UNITED STATES PATENTS

| | | | |
|---|---|---|---|
| 545,528 | 9/1895 | Paul | 30/340 X |
| 751,848 | 2/1904 | Goldsmith | 30/344 X |
| 903,093 | 11/1908 | Howe | 145/24 |
| 2,640,260 | 6/1953 | Taylor et al. | 30/162 |
| 2,870,537 | 1/1959 | Ortner | 30/162 |
| 2,885,780 | 5/1959 | Campbell | 30/162 X |
| 3,703,036 | 11/1972 | Karubian | 30/339 |

FOREIGN PATENTS OR APPLICATIONS

| | | | |
|---|---|---|---|
| 769,621 | 6/1934 | France | 30/344 |

*Primary Examiner*—Al Lawrence Smith
*Assistant Examiner*—J. T. Zatarga
*Attorney, Agent, or Firm*—Stephen J. Rudy

[57] ABSTRACT

A hand tool including a blade or tool part with a connected tang and a handle part with an aperture extending axially from one end for receiving the tang, a locking pin extending diametrically across the handle part and the tang being provided with a slot for the passage of said locking pin to a cross bore in the tang, the locking pin being rotatable or axially movable to engage it with said cross bore.

2 Claims, 7 Drawing Figures

HAND TOOLS

This application is a division of application Ser. No. 526,042, filed Nov. 21, 1974, now U.S. Pat. No. 3,935,889, dated Feb. 3,1976.

BACKGROUND OF THE INVENTION

The invention relates to hand tools and has for its object to provide an improvement therein.

According to the invention, a hand tool includes a blade or tool part with a connected tang, a handle part with an aperture extending axially from one end for receiving the tang, and locking means for locking the handle part on said tang, said locking means being constituted by a locking pin extending diametrically across the handle part intermediate the ends of the aperture for receiving the tang, and the tang being provided with a slot opening from its free end for the passage of the locking pin along said slot to a cross bore in said tang as the latter is received in the aperture in the handle part, the locking pin being rotatable or axially movable to engage it with the cross bore in the tang when the tang has been fully inserted in said handle part. The locking pin may be provided with oppositely disposed flats so that it can only be passed along the slot in the tang when apropriately orientated and in this case will preferably be provided with a lever pivotally connected to it at one end. The arrangement will preferably be such that when the handle has been secured to the tang the lever can be at least partly located in an inoperative position in a recess formed in the side surface of the handle part. Also in this case, the locking pin will preferably be retained in position in the handle part by means of a spring clip fitted at its end remote from the lever, the arrangement being such that the spring clip allows some slight cross-movement of the locking pin when lugs formed on said lever bear against the handle part, conveniently through the intermediary of a washer, as the lever is pivoted to an operative position, the return movement of the locking pin under the action of said spring clip when the lever is returned to its inoperative position causing said lever to be maintained in closed condition in the recess formed in the side surface of the handle part. On the other hand, the locking pin may be axially movable against the force of a spring, the arrangement being such that when the tang has been inserted in the handle part and the locking pin is released the force of the spring imparts a cross-movement to the locking pin to bring an enlargement formed on said pin into engagement with the cross bore in the tang. The tang will preferably be of cylindrical form and a shoulder will preferably be provided against which the handle part can abut when the tang has been inserted fully in the axially extending aperture. The slot in the tang will preferably be provided with a chamfer forming a lead-in for the locking pin as the tang is entered into the aperture in the handle part.

BRIEF DESCRIPTION OF DRAWING

In order that the invention may be fully understood and readily carried into effect, the same will now be described, by way of example only, with reference to the accompanying drawings, of which.

DESCRIPTION OF PREFERRED EMBODIMENT

Figure 1:
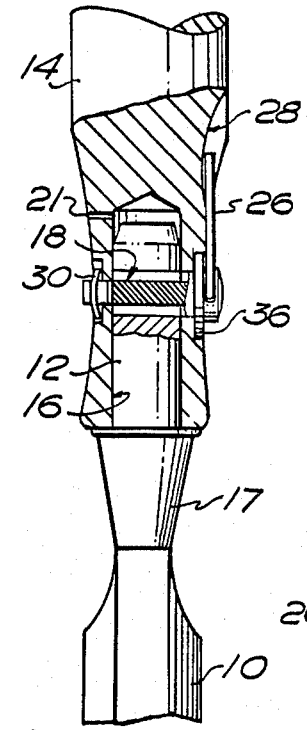
FIG. 1 is a part-sectional view through a hand tool embodying the invention.
Figure 2:
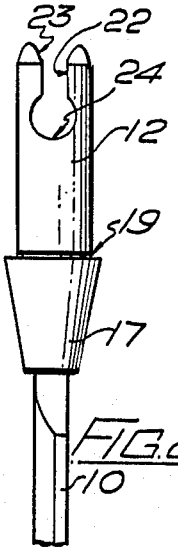
FIG. 2 is a view of the blade part thereof and a connected tang.

Referring now to FIGS. 1 to 5 of the drawings, the hand toll there illustrated includes a blade part 10 (in this case a chisel blade) with an integral tang 12 of generally cylindrical form. A handle part 14 is provided with an aperture 16 extending axially from one end for receiving the tang. A bolster portion 17 which is formed integrally with the tang 12 provides a shoulder 19 which abuts against the end of the handle part when the two components have been fitted together. The handle part is provided with a small hole 21 which allows the flow of air from within the aperture 16 as the tang is received therein.

Locking means for locking the handle part on the tang of the blade part are constituted by a locking pin extending diametrically across the handle part, as shown, intermediate the ends of the aperture 16. The tang 12 of the blade part is provided with a slot 22 opening from its free end for the passage of the locking pin, when appropriately oriented, along said slot to a cross bore 24 in said tang as the latter is received in the aperture in the handle part. The slot in the tang is provided with a generous chamfer 23 forming a lead-in for the locking pin as the tang is entered into the aperture in the handle part.

Figure 3:
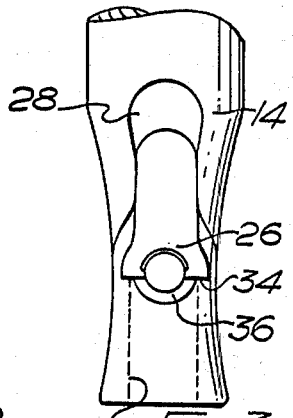
FIG. 3 is a side view of handle part of the tool.
Figure 4:
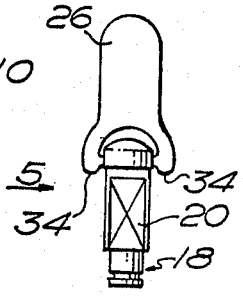
FIG. 4 is a side view of a locking pin for connecting the blade to the handle part.
Figure 5:
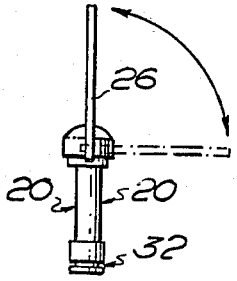
FIG. 5 is a view in the direction of arrow 5 in FIG. 4.

The locking pin 18 is rotatably mounted in the handle part so that it can be turned through a right angle to engage it with the cross bore 24 in the tang when the tang has been fully inserted in said handle part. A lever 26 is pivotally connected to one end of the locking pin for rotating the latter to engage it or disengage it with the cross bore in the tang, and the arrangement is such that, as shown in FIGS. 1 and 3, the lever can be partly located in an inoperative position in a recess 28 formed in the side surface of the handle part. The locking pin is retained in position in the handle part by means of a spring clip 30 fitted into a groove 32 at its end remote from the lever 26, and the arrangement is such that the spring clip allows some slight cross-movement of the locking pin when lugs 34 formed on said lever bear against a washer 36 which is disposed between the lever and the side surface of the handle part, that is to say, as the lever is pivoted to an operative position in line with the axis of the locking pin. The movement of the locking pin under the action of the spring clip when the lever is returned to its inoperative position causes the lever to be maintained in closed condition in the recess 28 in the side surface of the handle part.

Thus, there is provided a hand tool, the blade and handle part of which can very quickly and conveniently be fixed together or separated one from the other. Consequently, the construction of tang and cooperating handle is such that a set of blades or tools can be provided with a single handle for selective fitment to one of the blades or tools which it is desired to use.

Figure 6:
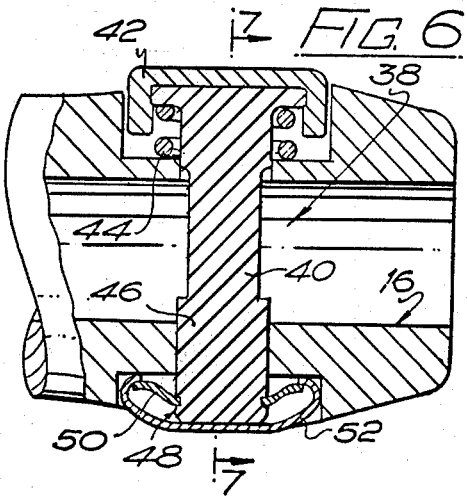
FIG. 6 is a part-sectional view through a hand tool of modified construction.
Figure 7:
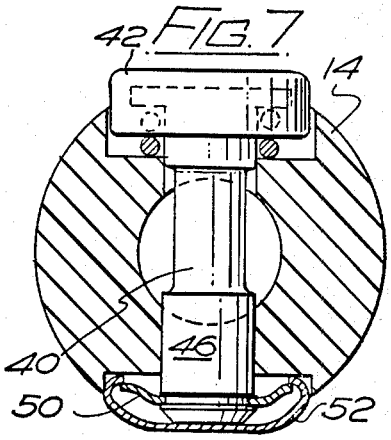
FIG. 7 is a sectional view on the line 7—7 in FIG. 6.

Referring now to FIGS. 6 and 7, in a modification of the hand tool just described, the locking means constituted by the locking pin 18 with oppositely disposed flats has been replaced by a locking pin 38 which is of cylindrical form throughout, that is to say, having a cylindrical major length 40 longer than the diameter of the aperture 16 of the handle part, a head 42 at one end beneath which a spring 44 is held captive, and a cylindrical enlargement 46 at its other end which is provided with a groove 48 in which a retaining spring washer is fitted. The spring washer is provided, as shown, with a domed head 52 which encloses the end of the cylindrical enlargement 46. The arrangement is such that the blade provided with a tang identical to that illustrated in FIG. 2 can be connected to the handle part, the tang being entered into the aperture in the handle part when the head of the locking pin has been depressed against the force of the spring 44 to move the enlargement 46 clear of said aperture (that is to say, the cylindrical major length 40 of the locking pin sliding along the slot in the tang as the latter is inserted in the handle part). When the head of the locking pin is then released, the force of the spring imparts a cross-movement of the locking pin to engage the enlargement 46 in the cross bore 24 of the tang. Of course, it will be realized that in this case the cross bore 24 need not necessarily extend completely through the tang.

Various other modifications may of course be made without departing from the scope of the invention and it will be understood that although the blade part illustrated is that of a joiner's chisel, numerous other kinds of hand tools or sets of hand tools may embody the invention, for example, screwdrivers, painters' and decorators' tools and the like. Instead of the shoulder formed on the bolster abutting directly against the handle part there could be a thin shock washer (made, for example, of a synthetic plastics material) interposed between the two. It will also be understood that the manner in which the blade or tool and handle part are secured together permits a considerable amount of torque to be applied to the blade or tool, as for example, to a screwdriver blade.

I claim:

1. A hand tool comprising a tool part provided with a tang having an axially extending slot in its free end opening into a crosshole, the diameter of the crosshole being greater than the width of the slot, a handle part having in an end thereof an axially extending aperture for receiving the tang; locking means for releasably locking the handle part to the tang comprising a locking pin extending diametrically through the handle part intermediately of the ends of the aperture and adapted to be moved transversely relative to the handle part, the pin having a first diametrical dimension defining a narrow major length allowing when registered with the slot sliding reception of the tang into the aperture over the pin until the pin is received into the crosshole, the pin having at one end a second diametrical dimension defining an enlarged portion obtaining in a predetermined moved condition of the pin transversely relative to the handle part a position protruding partway into the aperture and into the crosshole of the tang after the latter is received in the aperture so as to lock the tang against axial release from the aperture, and a spring biasing the pin normally to said moved condition; wherein the handle part has a recess at one side coaxial with the pin, the pin has a head at its other end defining an under-shoulder externally of the handle part, the spring is disposed between the under-shoulder and the bottom of the recess, the said one end of the pin projects externally of the handle part and carries a retaining clip, the clip having in said moved condition of the pin a position abutting an adjacent area of the hande part; and wherein the head end of the pin is depressible against the bias of the spring into the recess, and the pin has a moved position when so depressed in which its enlarged portion is displaced clear of the aperture and of the crosshole of the tang received in the aperture and its narrow major length is registered with the slot so as to allow axial release of the tang from the aperture.

2. A hand tool comprising a handle having an aperture extending axially into one end thereof, a tool part having a tang slidably entered into the aperture, the tang having an axially extending slot in its free end opening into a crosshole, the diameter of the crosshole being greater than the width of the slot, a locking pin extending diametrically through the handle intermediately of the ends of the aperture and passing through the crosshole, the pin having a major portion of narrow diameter adapted to be slidably received in the slot of the tang and having at a first end of the major portion a shorter portion of greater diameter than the width of the slot, the pin having a transversely actuated position relative to the handle in which its shorter portion is clear of the crosshole and its major portion is registered with the slot allowing axial movement of the tang relative to the pin from the aperture, the pin having a normal position in which its shorter portion protrudes part way into the crosshole preventing axial movement of the tang from the aperture relative to the pin, and a spring biasing the pin to its normal position; wherein the handle has a recess at one side coaxial with the pin, the pin has a head at the other end of its major portion defining an under-shoulder externally of the handle, the spring is disposed between the under-shoulder and the bottom of the recess, the said first end of the pin projects externally of the handle and carries a retaining clip, the clip having in said normal position of the pin a position abutting an adjacent area of the handle; and wherein the head end of the pin is depressible against the bias of the spring into the recess, and the pin obtains said actuated position when so despressed.

* * * * *